US009670625B2

(12) United States Patent
Bowers

(10) Patent No.: US 9,670,625 B2
(45) Date of Patent: Jun. 6, 2017

(54) ROAD SURFACE MAINTENANCE MATERIAL FORMS

(71) Applicant: Roger G. Bowers, Gila Bend, AZ (US)

(72) Inventor: Roger G. Bowers, Gila Bend, AZ (US)

( * ) Notice: Subject to any disclaimer, the term of this patent is extended or adjusted under 35 U.S.C. 154(b) by 300 days.

(21) Appl. No.: 14/301,291

(22) Filed: Jun. 10, 2014

(65) Prior Publication Data

US 2014/0294502 A1 Oct. 2, 2014

Related U.S. Application Data

(63) Continuation of application No. 11/870,707, filed on Oct. 11, 2007, now abandoned.

(51) Int. Cl.
*E01C 11/00* (2006.01)

(52) U.S. Cl.
CPC ..... *E01C 11/005* (2013.01)

(58) Field of Classification Search
CPC ..... E01C 11/005; E01C 7/265; E01C 5/18
See application file for complete search history.

(56) References Cited

U.S. PATENT DOCUMENTS

| | | | | |
|---|---|---|---|---|
| 2,082,259 | A * | 6/1937 | Peden | 106/280 |
| 2,977,864 | A | 4/1961 | Pullar | |
| 2,978,351 | A | 4/1961 | Pullar | |
| 3,253,521 | A * | 5/1966 | Endres | 404/73 |
| 3,568,579 | A | 3/1971 | Hoad et al. | |
| 3,891,585 | A | 6/1975 | McDonald | |
| 3,930,100 | A | 12/1975 | McDonald | |
| 4,265,563 | A | 5/1981 | Marzocchi et al. | |
| 4,556,338 | A | 12/1985 | Fahey | |
| 4,699,540 | A | 10/1987 | Gibbon et al. | |
| 5,160,215 | A | 11/1992 | Jensen | |
| 5,223,031 | A * | 6/1993 | Sugi et al. | 106/277 |
| 5,236,497 | A | 8/1993 | Grzybowski | |
| 5,460,649 | A | 10/1995 | Strassman | |
| 5,906,454 | A | 5/1999 | Medico, Jr. et al. | |
| 6,102,613 | A * | 8/2000 | Medico et al. | 404/17 |
| 6,248,396 | B1 | 6/2001 | Helf | |
| 6,315,492 | B1 | 11/2001 | McIntosh | |
| 6,479,570 | B2 * | 11/2002 | Kamaishi et al. | 523/205 |
| 6,488,755 | B1 | 12/2002 | Seyler et al. | |
| 6,751,919 | B2 | 6/2004 | Calixto | |
| 7,597,503 | B2 * | 10/2009 | Hinding et al. | 404/75 |
| 7,607,859 | B2 * | 10/2009 | Shaw et al. | 404/75 |
| 2001/0020058 | A1 * | 9/2001 | Kamaishi et al. | 524/3 |
| 2003/0026652 | A1 * | 2/2003 | Broadway, III | 404/75 |
| 2004/0148887 | A1 * | 8/2004 | Di Pede | 52/408 |

OTHER PUBLICATIONS

Crafco, Inc. Pavement Preservation Products, Patching Products, HP High Performance Asphalt Repair, pp. 1-3.

* cited by examiner

*Primary Examiner* — Abigail A Risic
(74) *Attorney, Agent, or Firm* — Robert D. Atkins; Patent Law Group: Atkins and Associates, P.C.

(57) ABSTRACT

Road surface maintenance material including a core of cold-applied rubberized asphalt and an outer shell of aggregate material surrounding the core. The core and outer shell are in the shape of either a ball form, a string form, or a ribbon form.

18 Claims, 2 Drawing Sheets

FIG. 1
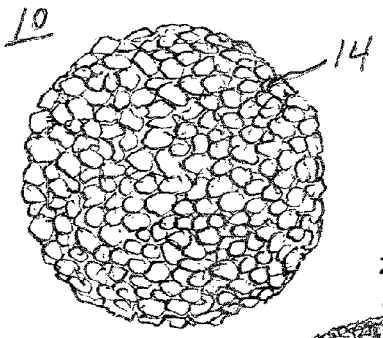
FIG. 2
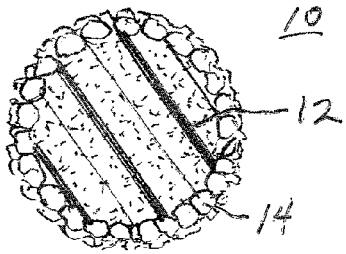
FIG. 3
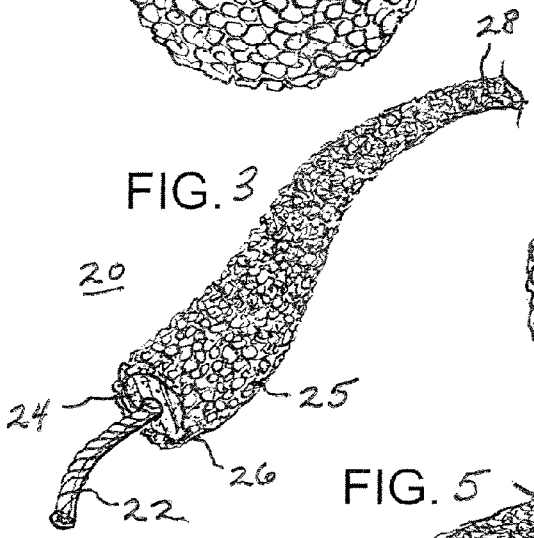
FIG. 4
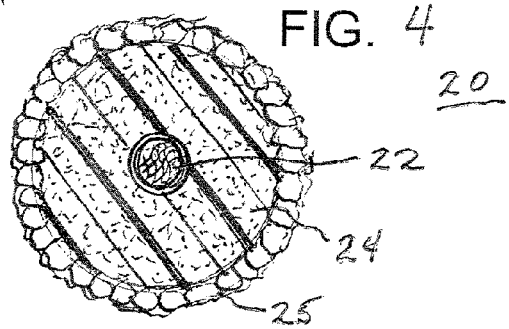
FIG. 5
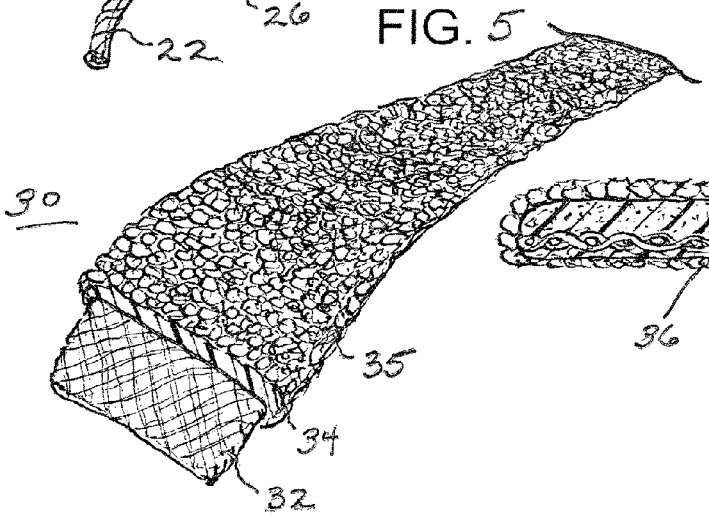
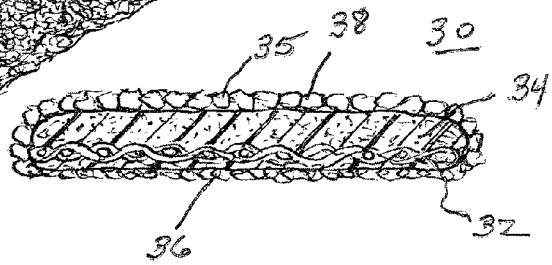
FIG. 6

ROAD SURFACE MAINTENANCE MATERIAL FORMS

CLAIM TO DOMESTIC PRIORITY

The present application is a continuation of U.S. patent application Ser. No. 11/870,707, filed Oct. 11, 2007, which is incorporated herein by reference.

FIELD OF THE INVENTION

This invention generally relates to materials in a special form used in the repair of road surfaces.

BACKGROUND OF THE INVENTION

In the field of road surface repair it is often necessary or desirable to repair cracks and potholes as they appear. The repair generally consists of applying some type of hot asphalt or asphalt product to the cracks and potholes. To apply the hot asphalt to a road surface requires a fairly large (approximately four tons) trailer towed heating and application machine. The machine melts bulk blocks or bags of the asphalt material into a semi-fluid by raising the temperature of the bulk material to approximately 425° F. to 450° F. The semi-fluid material is then applied to the road surface where needed through a manually operated application wand via a high pressure pump. The semi-fluid material will remain hot and sticky to the touch for some time and the road cannot be open to traffic until the semi-fluid material is adequately cooled.

Cold patch materials are available and will fill potholes and large cracks but cannot be used effectively on small cracks, small or shallow holes, or on concrete. Adhesion of this material is poor and never, ever, water tight on any hole whether small or large.

While hot applied rubberized asphalt will fill a pothole (small or large) with an absolute water tight seal, the drawbacks are the closure of the lane being repaired to traffic and the required equipment and man hours. There is also a loss of road surface friction in cooler temperatures as there is no aggregate contacting tire surfaces.

While surface friction loss is not mentionable with cold patch materials with aggregates, these materials are unable to make a watertight bond with the existing road material. With no water tight seal, a conventionally patched pothole is doomed to failure from the start. Further, while it fails, it also allows and facilitates continued degradation of surrounding road surface and subsurface material. Another shortcoming in the use of cold patch material is the required diligence and planning on the part of the labor factor to determine, shape, and place just the right amount of over-fill in the pothole so that when fully compacted by traffic the pothole patch and the road surface are the same level.

Lack of diligence by workers or inability to compute compaction ratios mentally will result in—what was a pothole in the road, is now a bump in the road. If the workers use too little cold patch material in a pothole, they will create an even less desired effect, i.e., a shallow spot on the road surface. The shallow spot is a place for water to pool in as it seeps through the non-water tight seam, where it degrades the subsurface, which then further degrades the original road surface.

Also, with current cold patch materials, it is so unlikely to effect a successful patch on a very small or just-starting hole that such attempts are seldom even made. Small cracks and potholes will generally bring the same response from the more senior work crew members to the new trainees, "That's not really big enough yet. Just let it grow." A safe thing to say since no maintenance supervisor is likely to criticize crew members for not attempting such patches, as their effectiveness-to-labor cost ratio is so well understood by all. No supervisor is likely to send a crew to do a section of road where there is just a few small holes. Labor cost-to-work completed is simply not justified, so they wait for a more labor cost/work done ratio to appear. Basically neglecting the road until adequately degraded.

It would be highly advantageous, therefore, to remedy the foregoing and other deficiencies inherent in the prior art.

Accordingly, it is an object of the present invention to provide new and improved road surface maintenance material forms and formation.

It is another object of the present invention to provide new and improved road surface maintenance material forms that are useful in a large variety of maintenance\repair applications and conditions.

It is another object of the present invention to provide new and improved road surface maintenance material forms that are useful in the repair of different sized and shaped road surface faults.

SUMMARY OF THE INVENTION

The above objects and others are realized in a road surface maintenance material including a core of cold-applied rubberized asphalt and an outer shell of aggregate material surrounding the core. The core and outer shell are in the shape of either a ball form, a string form, or a ribbon form.

The above objects and others are further realized in a method of maintaining road surfaces that includes the step of providing a supply of maintenance material in a form including at least one of a ball shaped form, a string shaped form, and a ribbon shaped form, each form including a core of cold-applied rubberized asphalt and an outer shell of aggregate material surrounding the core, and the string shaped form including an elongated fiber extending through the core of cold-applied rubberized asphalt, and the ribbon shaped form including an elongated piece of fabric-like material or mesh extending through the core of cold-applied rubberized asphalt. The method further includes the step of performing at least one of filling potholes in a road with a plurality of the ball shaped forms, filling cracks in a road with at least one of the string shaped forms, and filling depressions in a road with at least one of the ribbon shaped forms.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which:

FIG. 1 is a view in perspective of a first road surface maintenance material form in accordance with the present invention;

FIG. 2 is a sectional view of the first form illustrated in FIG. 1;

FIG. 3 is a view in perspective of a second road surface maintenance material form in accordance with the present invention;

FIG. 4 is a sectional view of the second form illustrated in FIG. 3;

FIG. 5 is a view in perspective of a third road surface maintenance material form in accordance with the present invention;

FIG. 6 is a sectional view of the third form illustrated in FIG. 5;

DETAILED DESCRIPTION OF THE DRAWINGS

Figure 7:
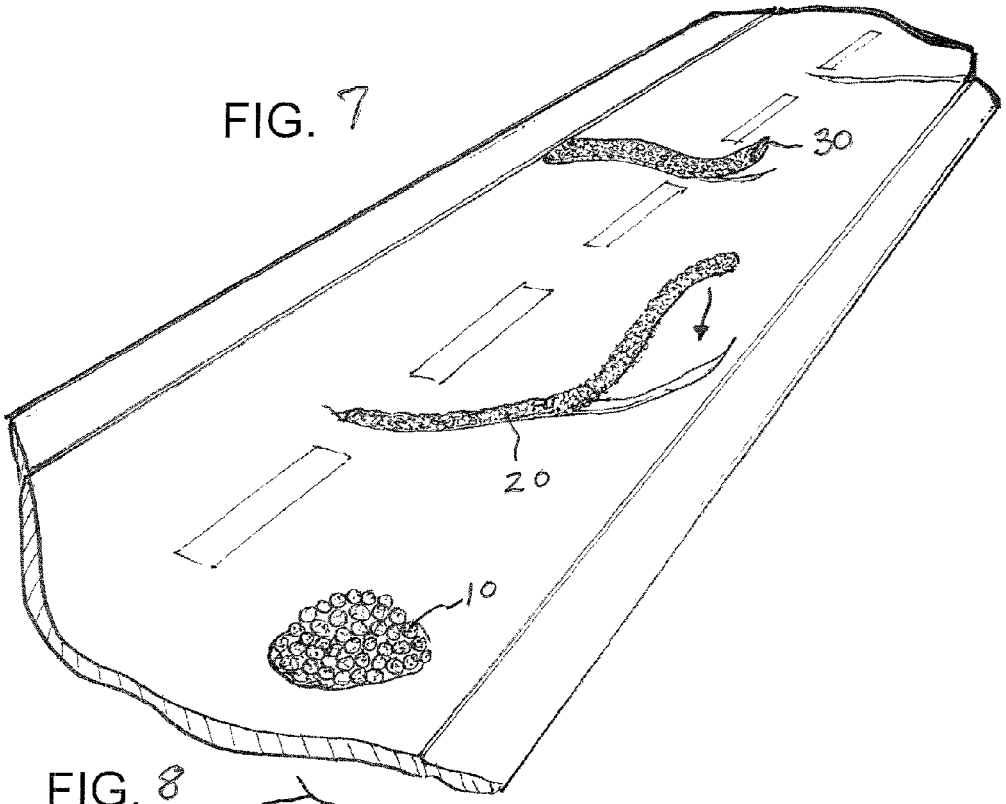
FIG. 7 is a top perspective view of a section of road illustrating uses of the three road surface maintenance material forms.

Turning now to the drawings, attention is first directed to FIGS. 1 and 2 which illustrate a first road surface maintenance material form 10 in accordance with the present invention. First maintenance material form 10 is in the shape of small balls or spheres of material with a core 12 of cold-applied rubberized asphalt and an outer surface or shell of aggregate material 14. The core of rubberized asphalt can be formed about a central seed such as a pebble or rock if desired, to help maintain the shape. The cold-applied rubberized asphalt material can be, for example, a material sold by CRAFCO Inc., having a place of business at Chandler, Ariz.

The outer diameter of first maintenance material form 10 can vary from fractions of an inch to two inches or more. Further, any specific quantity of first maintenance material forms 10 to be used for road repair can include single diameter material or different diameter material, depending upon the specific application intended. However, it is preferred that quantities of first maintenance material form 10 to be used for road repair include substantially single diameter material because of the simplicity in manufacturing and use. Aggregate material 14 can be selected for size and quality depending upon the outer diameter of first maintenance material form 10 that is desired. For example, smaller diameter balls could use smaller diameter aggregate and vice versa. It is preferred, however, to use a standard sized aggregate to simplify manufacturing and use.

Referring to FIGS. 3 and 4, a second road surface maintenance material form 20 is illustrated, in accordance with the present invention. Second maintenance material form 20 includes an elongated fiber 22 surrounded by a core of cold-applied rubberized asphalt 24 and an outer surface or shell of aggregate material 25 to produce a thin string of material. The elongated fiber is included to control stretching of second maintenance material form 20. The cold-applied rubberized asphalt material can be, for example, a material sold by CRAFCO Inc., having a place of business at Chandler, Ariz. Second maintenance material form 20 may taper slightly from a first end 26 toward a second end 28 or second maintenance material form 20 may have a relatively constant diameter over its length. For convenience in handling, a portion of fiber 22 extends from first end 26. Also, second maintenance material form 20 may be manufactured in different lengths and diameters so that one or more can be placed lengthwise in cracks in the road. As explained in conjunction with FIGS. 1 and 2 above, the outer diameter of second maintenance material form 20 can vary from fractions of an inch to two inches or more. However, it is preferred that quantities of second maintenance material form 20 to be used for road repair include substantially single diameter material because of the simplicity in manufacturing and use. Aggregate material 25 can be selected for size and quality depending upon the outer diameter of second maintenance material form 20 that is desired.

Referring to FIGS. 5 and 6, a third road surface maintenance material form 30 is illustrated, in accordance with the present invention. Third maintenance material form 30 is comprised of a flat elongated piece of fabric-like material or mesh 32 surrounded by a core of cold-applied rubberized asphalt 34 with an outer surface or shell of aggregate material 35 producing a flat ribbon with a lower surface 36 and an upper surface 38. The cold-applied rubberized asphalt material can be, for example, a material sold by CRAFCO Inc., having a place of business at Chandler, Ariz. Third maintenance material form 30 may taper slightly from a first end toward a second end or third maintenance material form 30 may have a relatively constant width over its length. Also, third maintenance material form 30 may be manufactured in different lengths and widths so that one or more can be placed lengthwise or adjacent in small depressions in the road or, more probably over very small cracks that conventionally would not be repaired, but pass water through to the sub-base. The width of third maintenance material form 30 can vary from fractions of an inch to three inches or more. However, it is preferred that quantities of third maintenance material form 30 to be used for road repair include substantially single width material because of the simplicity in manufacturing and use. Aggregate material 35 can be selected for size and quality depending upon the width of third maintenance material form 30 that is desired. Also, because third maintenance material form 30 is intended for use in small cracks, it is preferred that fabric-like material or mesh 32 be situated nearer lower surface 36 and that the amount of aggregate material 35 on lower surface 36 be less than on the other surfaces, i.e., upper surface 38. In a particular embodiment, there actually may be nothing on the lower surface of mesh 32, with rubberized asphalt 34 and aggregate material 35 only on the upper surface, or only rubberized asphalt on the lower surface.

Figure 8:
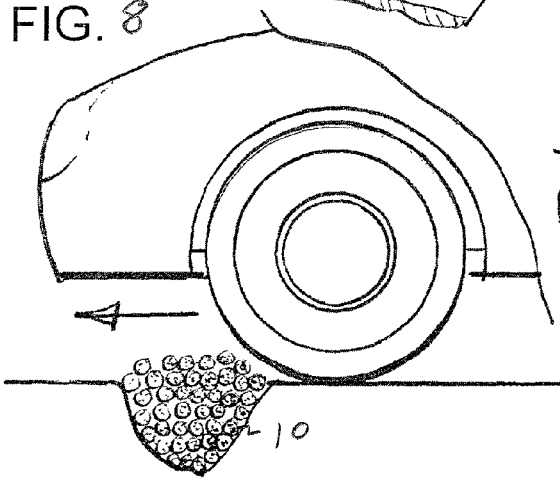
FIG. 8 is a sectional view of a pothole in a road surface with the first road surface maintenance material form of FIG. 1 applied thereto.

Turning to FIGS. 7 and 8, it can be seen that first road surface maintenance material form 10 is primarily intended as a maintenance material for potholes and deep faults in a road. The workers simply fill the pothole with first road surface maintenance material form 10 as illustrated. Here it should be noted that because each ball comprising first maintenance material form 10 is coated with aggregate material 14, the balls can be easily stored and distributed (i.e., remain discrete) without sticking together or otherwise congealing into one form. Through normal use of the road, vehicles compress the small balls of material into a compact fill that forms a solid, waterproof bond between adjacent balls as well as between balls and the adjacent remaining or surrounding road material. First road surface maintenance material form 10 has a self-leveling characteristic that prevents bumps from occurring when a larger than required amount is used in a crack or pothole. The self-leveling characteristic is partially due to the inclusion of aggregate in each ball and partially due to the use of cold-applied rubberized asphalt 12.

Figure 9:
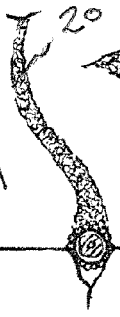
FIG. 9 is a sectional view of a small crack in a road surface with the second road surface maintenance material form of FIG. 3 applied thereto.

Turning to FIGS. 7 and 9, it can be seen that second road surface maintenance material form 20 is primarily intended as a maintenance material for cracks in a road wide enough to be filled. The worker simply lays one or more of the thin strings of material (second forms 20) lengthwise in the crack as illustrated. Here it should be noted that because each string comprising second maintenance material form 20 is coated with aggregate material 25, the strings can be easily stored and distributed (i.e., remain discrete) without sticking together or otherwise congealing into one form. Also, if desired the end of fiber 22 extending from first end 26 can be used as a convenient handle for each string of material. Through normal use of the road, vehicles compress the thin strings of material into a compact fill that forms a solid, waterproof bond between the thin strings and remaining or surrounding road material. Second road surface maintenance material form 20 has a self-leveling characteristic that prevents bumps from occurring when a larger than required amount is used in a crack. The self-leveling characteristic is partially due to the inclusion of aggregate in each string and partially due to the use of cold-applied rubberized asphalt 24.

Figure 10:
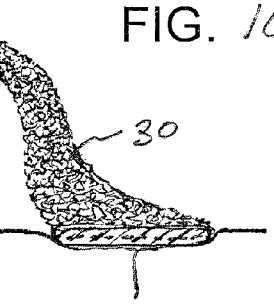
FIG. 10 is a sectional view of a wide crack in a road surface with the third road surface maintenance material form of FIG. 5 applied thereto.

Turning to FIGS. 7 and 10, it can be seen that third road surface maintenance material form 30 is primarily intended as a maintenance material for small cracks in a road which are too small to be filled but will still pass water through to the sub-base. The worker simply lays one or more of the ribbons of material (third forms 30) lengthwise over the crack as illustrated. Here it should be noted that because each ribbon comprising third maintenance material form 30 is coated with aggregate material 35, the ribbons can be easily stored and distributed (i.e., remain discrete) without sticking together or otherwise congealing into one form. Through normal use of the road, vehicles compress the ribbons of material into a compact fill that forms a solid, waterproof bond between the ribbons and remaining or surrounding road material. Further, because a smaller amount of aggregate 35 is preferably incorporated on lower surface 36 the ribbons form a very good bond with the remaining road material. Third road surface maintenance material form 30 has a self-leveling characteristic that prevents bumps from occurring when a larger than required amount is used on a crack. The self-leveling characteristic is partially due to the inclusion of aggregate in each ribbon and partially due to the use of cold-applied rubberized asphalt 34.

Thus, new and improved road surface maintenance material forms are disclosed that contain cold-applied rubberized asphalt surrounded by aggregate material. Because the various forms are fabricated with an outer coating of aggregate, they can be stored or carried in convenient quantities without sticking together and can be conveniently distributed into road faults, i.e., potholes, cracks, and the like, without the need for large equipment. Further, because the maintenance material forms are relatively small they can be conveniently used to repair relatively small faults in a road without undue effort or labor. For example, the maintenance material forms can be applied as soon as a need is located with full effectiveness. No crack is too small and no pothole is too shallow to be 100% water tight effectively fixed. Also, in most cases the repairs can be effected with just a pickup or one ton truck and a crew of two, working in between traffic with no or minimum signing or traffic control necessary. This procedure allows more time to find and apply more timely and effective road maintenance with far less secondary labor costs, e.g., signing and traffic control set up and take down costs. Further, during standard road repair it is unnecessary to use large equipment such as cone trucks, hot application machines, bobtail size trucks to carry cold patch material or act as attenuator vehicles, or oil boots.

Another advantage in the use of the new and improved road surface maintenance material forms is the available immediate use of the road by traffic after application with less fly-off hazard. Being able to make immediate and effective repairs to a crack or small hole or leaky seam translates into much longer roadway life span with more hours actually spent repairing road surface problems and less spent on work support type labor.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is.

What is claimed:

1. A road surface maintenance material, comprising:

an elongated core fibrous material including a flat surface;

a rubberized asphalt formed completely around the elongated core fibrous material, wherein an amount of the rubberized asphalt formed on a first side of the elongated core fibrous material is greater than an amount of the rubberized material formed on a second side of the elongated core fibrous material opposite the first side of the elongated core fibrous material; and an outer shell of aggregate material completely around the rubberized asphalt.

2. The road surface maintenance material of claim 1, wherein the elongated core fibrous material, rubberized asphalt, and outer shell includes a width ranging from less than one inch to two inches.

3. The road surface maintenance material of claim 1, wherein the elongated core fibrous material includes a string or ribbon.

4. The road surface maintenance material of claim 1, wherein the rubberized asphalt is compressible under pressure at ambient temperature.

5. The road surface maintenance material of claim 1, wherein the elongated core fibrous material, rubberized asphalt, and outer shell includes a tapered contour.

6. The road surface maintenance material of claim 1, wherein the elongated core fibrous material, rubberized asphalt, and outer shell includes a constant width over its length.

7. A road surface maintenance material, comprising:

a plurality of spheres of the road surface maintenance material, each sphere of the road surface maintenance material including, (a) a solid core seed, (b) a rubberized asphalt formed completely around the solid core seed, and (c) an outer shell of aggregate material completely surrounding the rubberized asphalt.

8. The road surface maintenance material of claim 7, wherein the solid core seed includes a rock or pebble.

9. The road surface maintenance material of claim 7, wherein the spheres of the road surface maintenance material include a width ranging from less than one inch to two inches.

10. The road surface maintenance material of claim 7, wherein the rubberized asphalt is compressible under pressure at ambient temperature.

11. A method of applying road surface maintenance material to a roadway, comprising:

providing a road surface maintenance material by, (a) providing an elongated core fibrous material, (b) forming a rubberized asphalt around the completely around the elongated core fibrous material, and (c) forming an outer shell of aggregate material completely around the rubberized asphalt;

disposing the road surface maintenance material in an opening of a roadway; and applying pressure to the road surface maintenance material in the opening from vehicle traffic at ambient temperature to seal the opening in the roadway.

12. The method of claim 11, wherein the elongated core fibrous material includes a flat mesh.

13. The method of claim 11, further including forming an amount of the rubberized asphalt on a first side of the elongated core fibrous material to be greater than an amount of the rubberized material on a second side of the elongated core fibrous material opposite the first side of the elongated core fibrous material.

14. The method of claim 11, wherein the elongated core fibrous material, rubberized asphalt, and outer shell includes a tapered contour.

15. The method of claim 11, further including forming the elongated core fibrous material, rubberized asphalt, and outer shell to a width ranging from less than one inch to two inches.

16. The method of claim 11, wherein a shape of the elongated core fibrous material includes a string or ribbon.

17. The road surface maintenance material of claim 11, wherein the elongated core fibrous material extends from one end of the rubberized asphalt.

18. The road surface maintenance material of claim 11, wherein the elongated core fibrous material, rubberized asphalt, and outer shell includes a constant width over its length.

* * * * *